US006773072B2

(12) United States Patent
Phillips et al.

(10) Patent No.: US 6,773,072 B2
(45) Date of Patent: Aug. 10, 2004

(54) VERTICALLY AND HORIZONTALLY ADJUSTABLE CHAIR ARMREST

(75) Inventors: Matthew J. Phillips, Muscatine, IA (US); Jay R. Machael, Muscatine, IA (US); Brian R. Trego, Muscatine, IA (US)

(73) Assignee: HON Technology Inc., Muscatine, IA (US)

( * ) Notice: Subject to any disclaimer, the term of this patent is extended or adjusted under 35 U.S.C. 154(b) by 95 days.

(21) Appl. No.: 10/077,073

(22) Filed: Feb. 15, 2002

(65) Prior Publication Data

US 2002/0190561 A1 Dec. 19, 2002

Related U.S. Application Data

(63) Continuation-in-part of application No. 09/881,818, filed on Jun. 15, 2001.

(51) Int. Cl.[7] ..... A47C 7/54

(52) U.S. Cl. ..... 297/411.35; 248/118; 297/411.36

(58) Field of Search ..... 297/115, 116, 297/344.26, 411.35, 411.36, 411.37, 411.38, 411.31, 411.2, 344.19, 353; 248/118, 118.3, 162.1, 6.31, 289.11

(56) References Cited

U.S. PATENT DOCUMENTS

| | | | | |
|---|---|---|---|---|
| 5,393,124 A | | 2/1995 | Neil | |
| 5,407,249 A | | 4/1995 | Bonutti | |
| 5,590,934 A | | 1/1997 | Gibbs | |
| 5,641,203 A | | 6/1997 | Van De Riet et al. | |
| 5,647,638 A | | 7/1997 | Ritt et al. | |
| 5,655,814 A | | 8/1997 | Gibbs | |
| 5,749,628 A | | 5/1998 | Synder et al. | |
| 5,765,804 A | | 6/1998 | Stumpf et al. | |
| 5,848,823 A | * | 12/1998 | Su | 297/411.36 |
| 5,853,223 A | | 12/1998 | Ritt et al. | |
| 5,884,976 A | | 3/1999 | Breen et al. | |
| 5,895,095 A | | 4/1999 | Chen | |
| 5,908,221 A | * | 6/1999 | Neil | 297/411.36 |
| 5,931,536 A | | 8/1999 | Wu | |
| 5,944,386 A | | 8/1999 | Yamagishi et al. | |
| 5,971,484 A | | 10/1999 | Lamart et al. | |
| 6,045,191 A | | 4/2000 | Piretti | |
| 6,053,578 A | | 4/2000 | van Hekken et al. | |
| 6,076,892 A | * | 6/2000 | van Hekken et al. | 297/411.35 |
| 6,106,070 A | | 8/2000 | Ritt et al. | |
| 6,296,312 B1 | * | 10/2001 | Congleton et al. | 297/411.35 |

* cited by examiner

*Primary Examiner*—Peter M. Cuomo
*Assistant Examiner*—Stephen Vu
(74) *Attorney, Agent, or Firm*—Ronald A. Sandler; Jones Day

(57) ABSTRACT

A vertically and horizontally adjustable chair armrest is disclosed. The armrest includes an outer shroud, an upstanding support with a central opening and an armrest base. Within the central opening is a guide tube that moves vertically and has oppositely disposed slots. Within the guide tube, but mounted to rotate only, is a rod. At the lower end of the rod is a locking element that extends through the slots in the guide tube. The rod is rotated by a user pivoted lever bearing down on a spring biased activator nut. The nut is keyed to move only in a linear direction but is threaded to engage a mating thread on the rod, thereby causing the rod to rotate. When the locking element is rotated out of engagement with notches in the support opening, the armrest may be adjusted in a vertical direction. Releasing the lever allows the spring to bias the locking element into engagement with the notches to lock the armrest. Horizontal adjustment entails pivoting the armrest from one detent to another within a 45 degree arc.

14 Claims, 9 Drawing Sheets

VERTICALLY AND HORIZONTALLY ADJUSTABLE CHAIR ARMREST

CROSS-REFERENCE TO RELATED APPLICATIONS

The present application is a continuation-in-part of Application Ser. No. 09/881,818 filed Jun. 15, 2001 entitled "Height And Pivot Adjustable Chair Arm" and is related to co-pending Application Ser. No. 10/077,409 entitled "Improved Ergonomic Chair" filed on even date herewith and commonly assigned, the disclosures of which are incorporated herein by reference.

BACKGROUND OF THE INVENTION

1. Field of the Invention

The present invention relates to an adjustable chair armrest and more particularly to a vertically and horizontally adjustable chair armrest that is simply constructed and easy to use.

2. Description of the Related Art

Office chairs are frequently adjustable in seat height and armrest height. See for example U.S. Pat. Nos. 5,755,488, 5,765,804 and 5,971,484. Some of these chair armrests are also adjustable horizontally as shown in U.S. Pat. No. 5,641,203. However, such armrests are complicated structurally and/or difficult to use.

BRIEF SUMMARY OF THE INVENTION

What is described here is a vertically and horizontally adjustable chair armrest comprising a support for connecting to a chair, the support having a longitudinally extending opening, a plurality of notches located in the opening, a guide tube positioned in the opening of the support, the guide tube being movable relative to the support in a longitudinal direction wherein the height of the guide tube relative to the support is changeable, an elongated element mounted in the guide tube, the elongated element being rotatable relative to the guide tube, a locking element mounted to the elongated element and rotatable therewith to selectively engage and disengage the notches, an activator mounted to the elongated element, the activator being movable relative to the elongated element and causing the elongated element to rotate, a spring operatively connected to the activator for biasing the activator, a lever operatively connected to the support for causing the activator to move, a cap mounted to the guide tube, and an armrest base operatively connected to the cap, the armrest base being movable in a generally horizontal direction relative to the cap.

There are a number of advantages, features and objects achieved with the present invention which are believed not to be available in earlier related devices. For example, one advantage is that the present invention provides an armrest assembly that is easily adjustable both vertically and horizontally. Another object of the present invention is to provide an adjustable chair armrest that is simply constructed and reliable. Yet another advantage of the present invention is an armrest assembly that is easy to form and then easy to assemble.

A more complete understanding of the present invention and other objects, advantages and features thereof will gained from a consideration of the following description of a preferred embodiment read in conjunction with the accompanying drawing provided herein. The preferred embodiment represents an example of the invention which is described here in compliance with Title 35 U.S.C. section 112, but the invention itself is defined by the attached claims.

DETAILED DESCRIPTION OF A PREFERRED EMBODIMENT OF THE INVENTION

Figure 1:
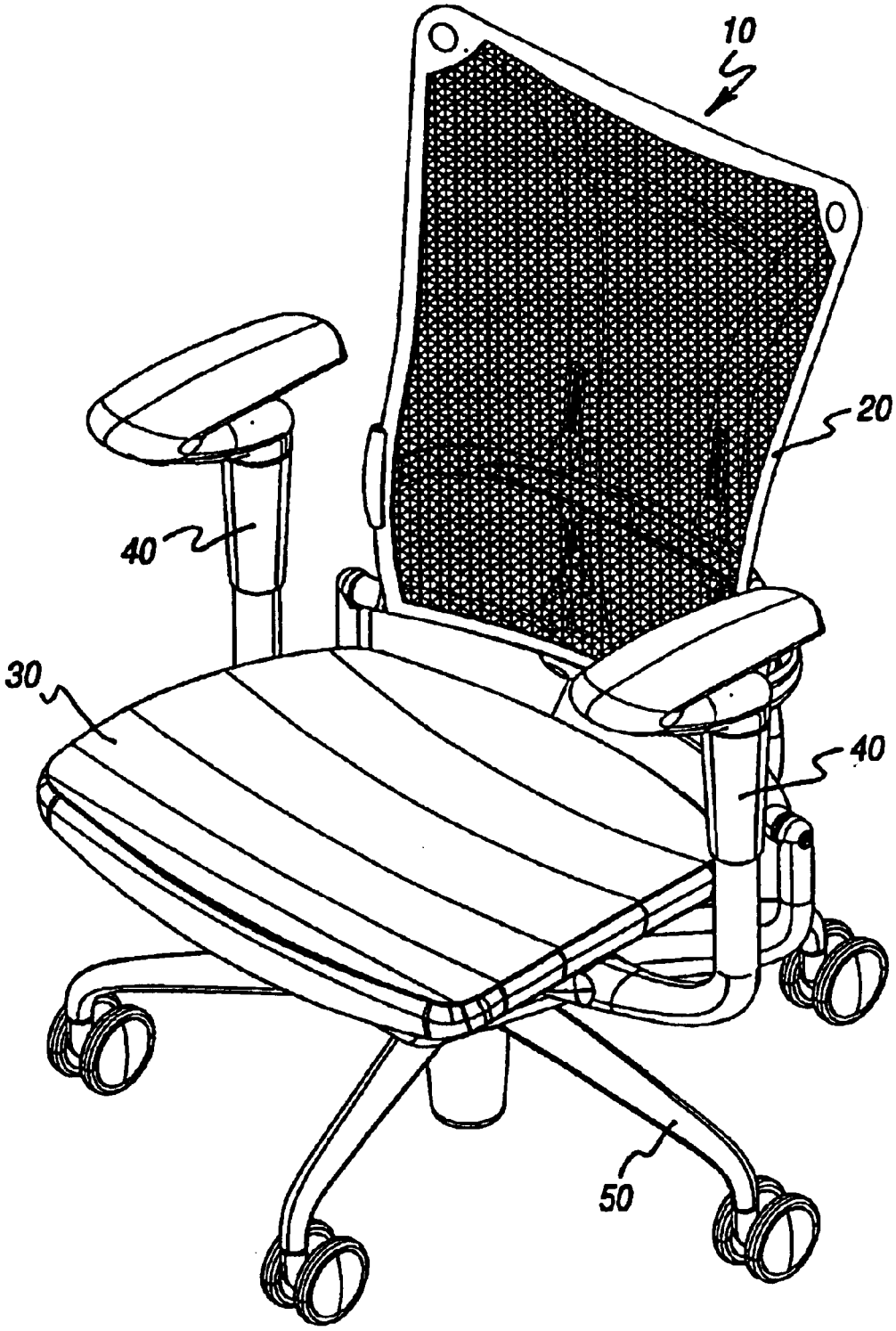
FIG. 1 is an isometric view of an office chair.

While the present invention is open to various modifications and alternative constructions, the preferred embodiment shown in the drawing will be described herein in detail. It is understood, however, that there is no intention to limit the invention to the particular embodiment, form or example disclosed herein. On the contrary, the intention is to cover all modifications, equivalent structures and methods, and alternative constructions falling within the spirit and scope of the invention as expressed in the appended claims, pursuant to Title 35 U.S.C. § 112 ($2^{nd}$ paragraph).

Referring now to FIG. 1, there is illustrated an office chair 10 having a backrest 20, a seat assembly 30, armrest assemblies 40 and a pedestal 50. The disclosure here concentrates on the armrest assemblies which are simply constructed and reliable and allow adjustment both vertically and horizontally.

Figure 3:
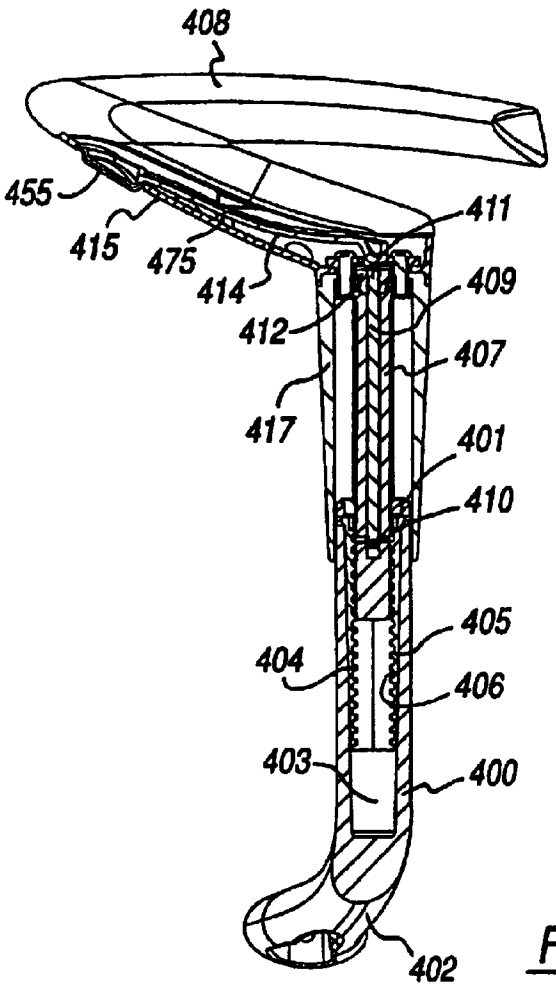
FIG. 3 is a sectional elevation view taken along line 3—3 of FIG. 2.
Figure 2:
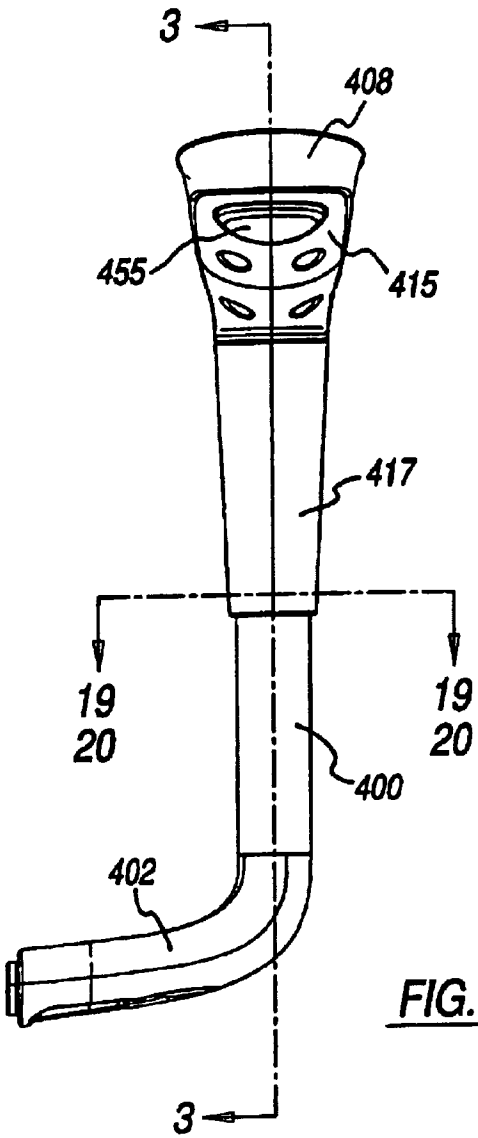
FIG. 2 is a front elevation view of an armrest assembly.

Referring now to FIGS. 2 and 3, the armrest assembly 40 generally includes an upstanding support 400 which has an open upper end portion 401, a curved lower end portion 402 and a longitudinally extending opening 403 extending downwardly from the upper end portion. Within the support opening 403 are mounted oppositely disposed liner racks 404, 405, each having a plurality of notches 406 extending in a longitudinal direction. As viewed in FIG. 3, the longitudinal direction is generally vertical.

Figure 4:
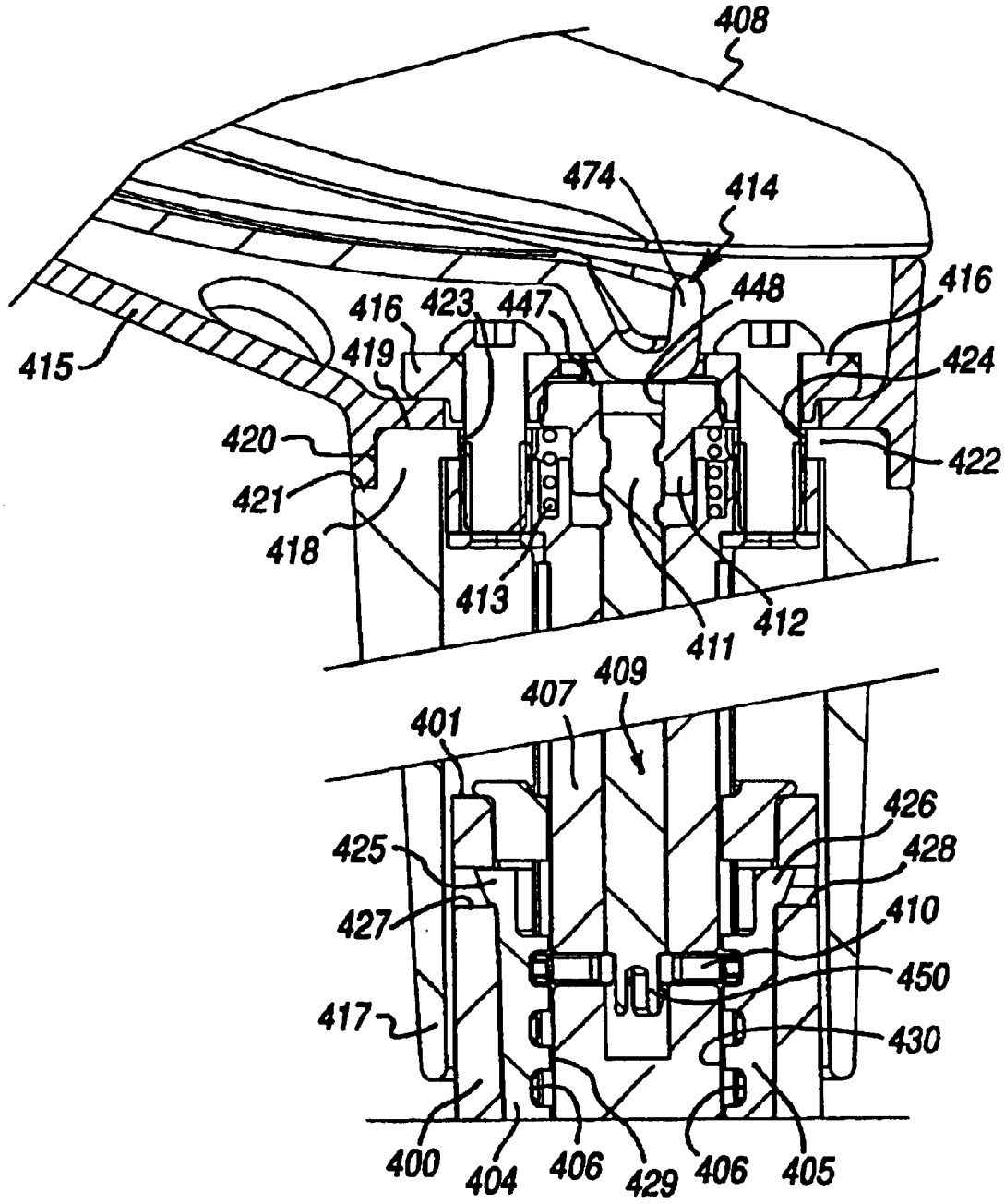
FIG. 4 is an enlarged view of a portion of the view of FIG. 3 showing the armrest assembly in a locked position.
Figure 5:
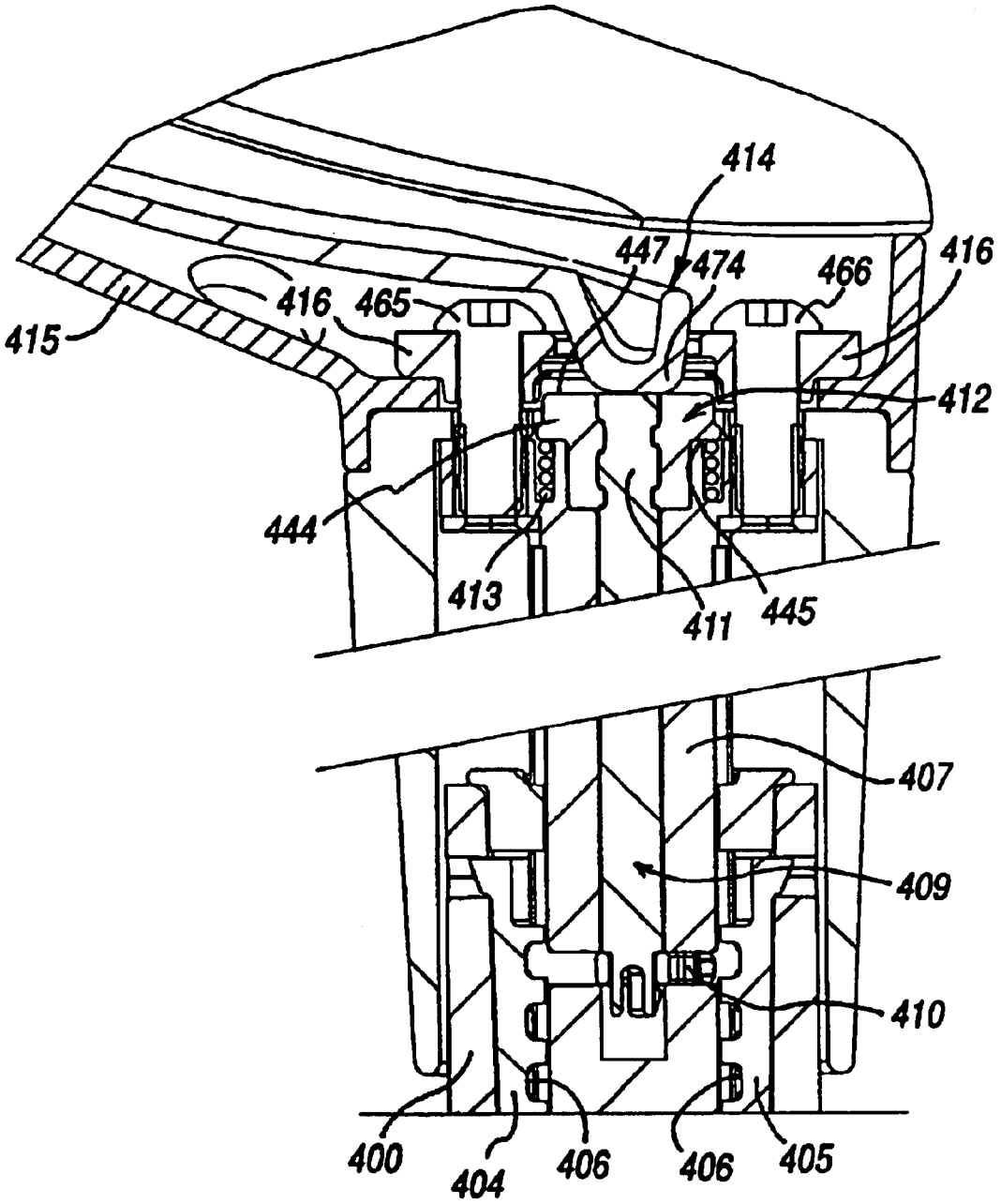
FIG. 5 is a view like that in FIG. 4 showing the armrest assembly in an unlocked position.
Figure 6:
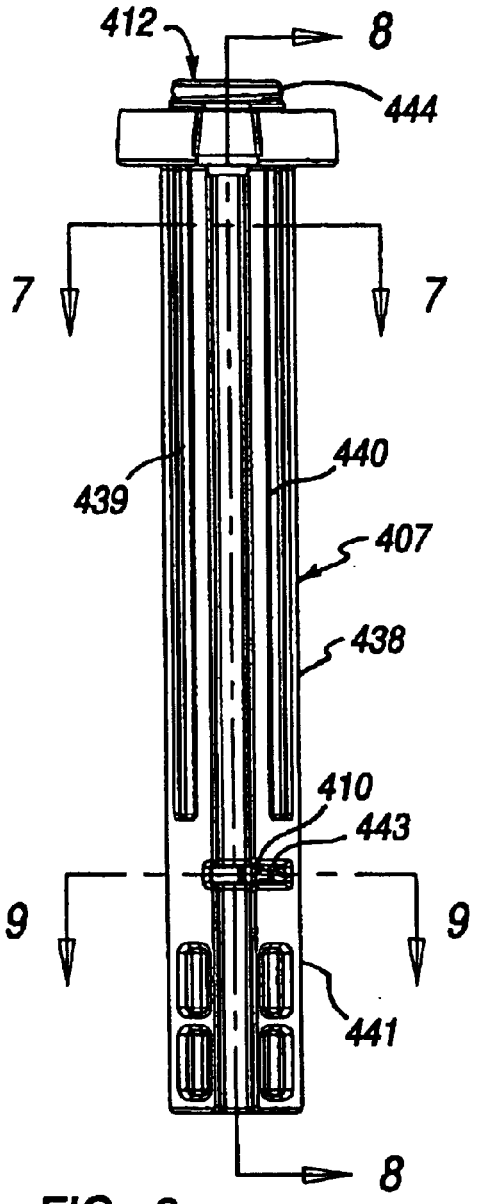
FIG. 6 is an elevation view of a guide tube.
Figure 8:
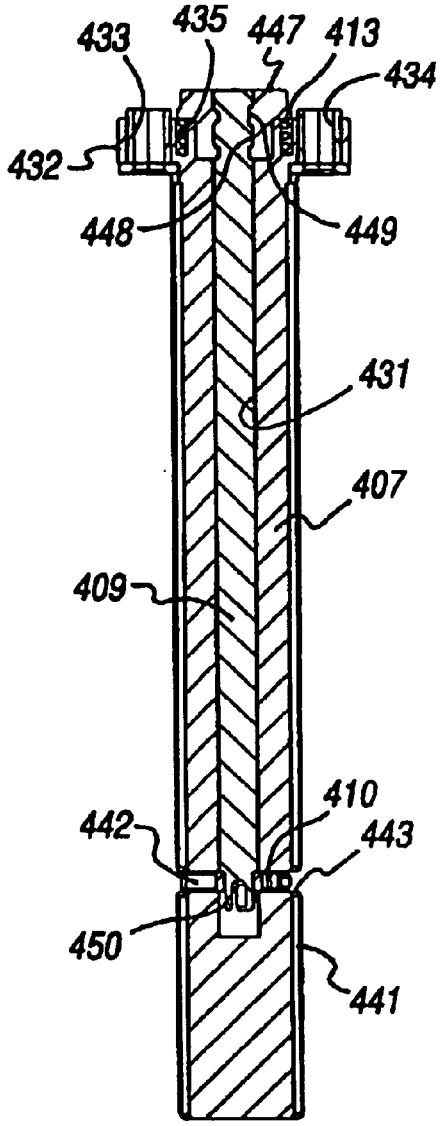
FIG. 8 is an elevation sectional view taken along line 8—8 of FIG. 6.
Figure 7:
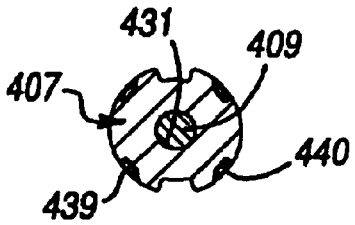
FIG. 7 is a plan sectional view taken along line 7—7 of FIG. 6.
Figure 9:
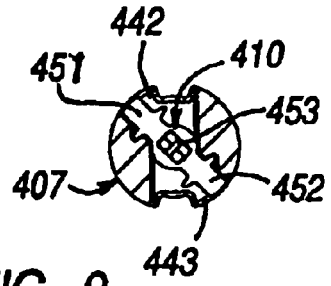
FIG. 9 is a plan sectional view taken along line 9—9 of FIG. 6.
Figure 11:
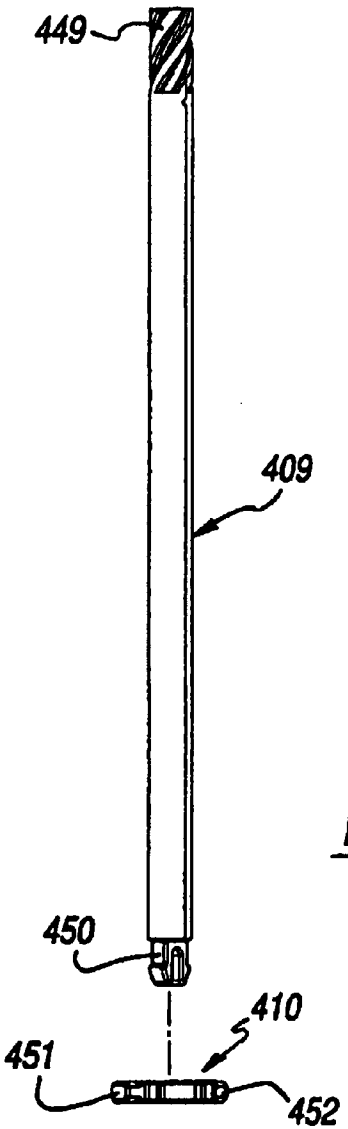
FIG. 11 is an enlarged elevation view of a rod.

Referring also to FIGS. 4 and 5, a guide tube 407 is positioned in the support opening 403 such that the guide tube is generally vertically movable relative to the support. An armrest 408 is mounted to the guide tube so that relative movement of the guide tube causes vertical adjustment of the armrest.

Within the movable guide tube is a elongated element 409 in the form of a rod, the rod being mounted within the guide tube to be rotatable only. As will be explained below, the rod does not slide vertically or longitudinally relative to the guide tube. Mounted to the elongated rod 409 is a locking element 410 which is rotatable with the rod to selectively engage and disengage the notches 406 of the liner racks 405, 405. Mounted at an upper end portion 411 of the rod is an activator nut 412 which engages the rod and causes the rod to rotate by the nut moving between raised (shown in FIG. 4) and lowered (shown in FIG. 5) positions. A spring 413 is mounted between the activator nut and the guide tube and biases the activator nut to the raised position whereby the rod is rotated to and maintained in a locked position. The activator nut is moved by a lever 414 which is operatively connected to the upstanding support by being pivotally mounted to an armrest base 415. A cap 416 is also mounted to the guide tube and is operatively connected to the armrest base to allow the base to pivot in a generally horizontal direction relative to the cap.

The upstanding support 400 has a generally cylindrical shape extending in a generally vertical direction. The lower end portion 402 of the upstanding support curves to a generally horizontal disposition allowing it to be attached to a frame member of the chair 10. The support is made of any suitable material, such as aluminum.

Formed around the upstanding support is a second cylindrical element 417, FIGS. 2 and 3, often referred to as a shroud. The shroud slides along the outside surface of the upstanding support and provides a pleasing aesthetic appearance to the armrest assembly. An upper part 418, FIG. 4, of the shroud 417 includes a first horizontal annular bearing surface 419, a vertical annular bearing surface 420 and a second horizontal annular bearing surface 421. These bearing surfaces engage corresponding bearing surfaces of the armrest base 415. The shroud also includes a top flange 422 having fastener receiving openings 423, 424.

As mentioned, within the upstanding support 400 are the two oppositely disposed liner racks 404, 405, with each rack including the plurality of notches 406. The racks have small tabs 425, 426 which engage openings 427, 428 in the upstanding support. In addition to the notches, the racks also include bearing surfaces 429, 430 for the vertically sliding guide tube 407.

The guide tube is generally cylindrical in shape and includes a central opening 431, FIGS. 6–10. The guide tube includes an upper end portion 432 including two fastener openings 433, 434, an annular groove 435 for receiving the spring 413 and two oppositely disposed keys 436, 437. Along an outside surface 438 of the guide tube are grooves, such as the grooves 439, 440, for limiting the upward travel of the guide tube. Toward a lower portion 441 of the guide tube, there are two circumferentially extending slots 442, 443. The slots each extend about an arc of about forty-five degrees. As will be explained below, the locking element 410 extends through the slots to make engagement with the notches 406. When engagement is made, the guide tube 407 and the attached armrest 408 are locked relative to the support 400. The slots 442, 443 also enable the locking element to rotate out of engagement with the notches through the forty-five degree arcs and thereby disengage the guide tube from the support allowing the guide tube to be moved vertically within the support opening 403. In this manner the armrest may be vertically adjusted.

Figure 10:
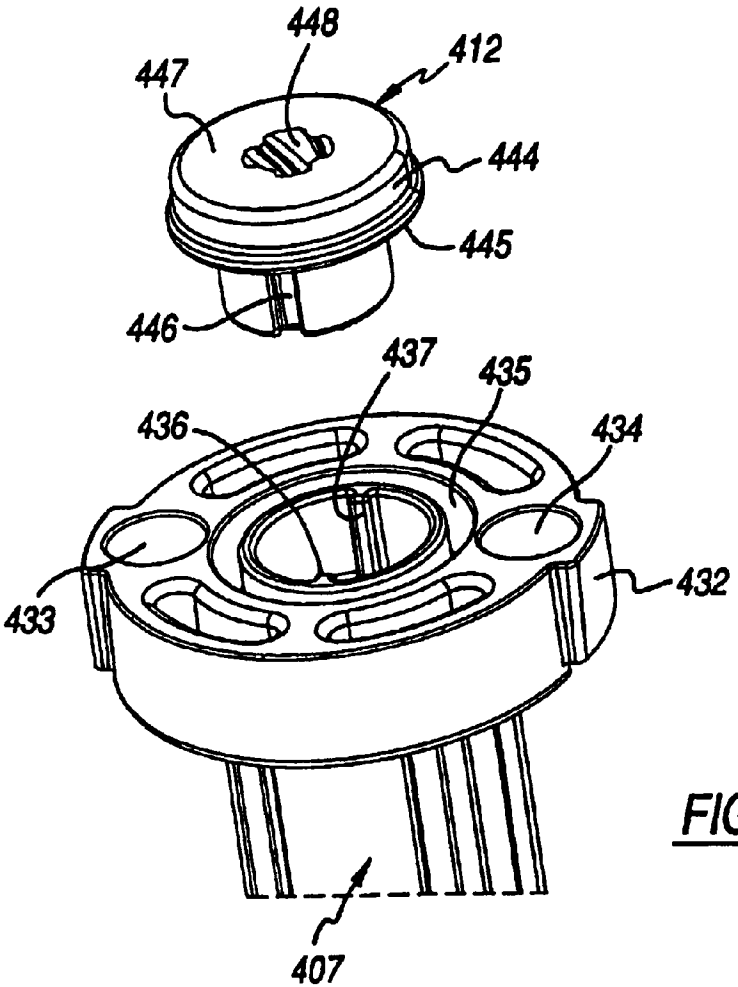
FIG. 10 is an enlarged exploded isometric view of the top of the guide tube and an activator nut.

Mounted to the guide tube 407 is the activator nut 412, FIGS. 4, 5, 6, 8 and 10. The activator nut includes an annular flange 444, having a spring retaining surface 445 and key slots, of which one key slot 446 is shown in FIG. 10, to accommodate the keys 436, 437 of the guide tube. The actuator nut also includes a top surface 447 to engage the lever 414 and a central threaded opening 448. The threaded opening engages the rod 409 causing the rod to rotate.

Mounted within the guide tube is the elongated rod 409, FIGS. 4, 7, 8, 9 and 11. The rod is mounted for rotational movement only and does not slide longitudinally in relation to the guide tube. At an upper end portion 411 of the rod is an external screw thread 449 which engages the internal screw thread 448 of the activator nut. In the lower portion of the rod is a snap fit connector 450 for engaging the locking element 410. The locking element has opposed extending arms 451, 452 and a central opening 453. The locking element central opening receives the snap fit connector of the rod, which deforms and then snaps back into place to make a connection.

The spring 413 is mounted within the annular groove 435 at the upper end portion 432 of the guide tube 407. An upper end of the spring bears against the surface 445 of the annular flange 444. Because of the keys and key slots, the activator nut moves between raised and lowered positions in a linear fashion as shown in FIGS. 4 and 5. When the activator nut is moved to its lowered position, the spring is compressed and forms a biasing force against the activator nut tending to return it to its raised position.

Figure 12:
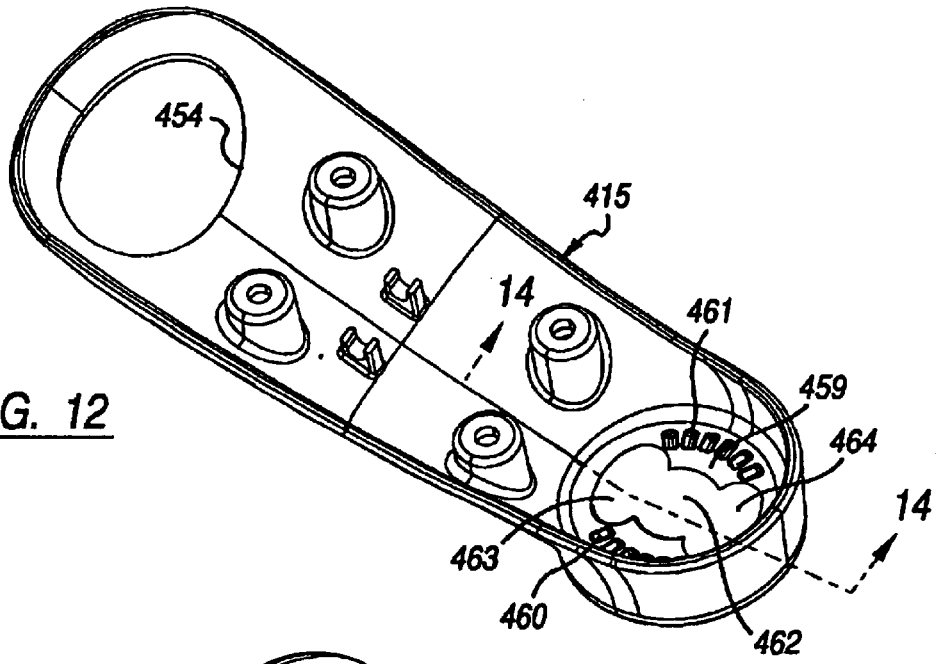
FIG. 12 is a downward looking isometric view of an armrest base.
Figure 13:
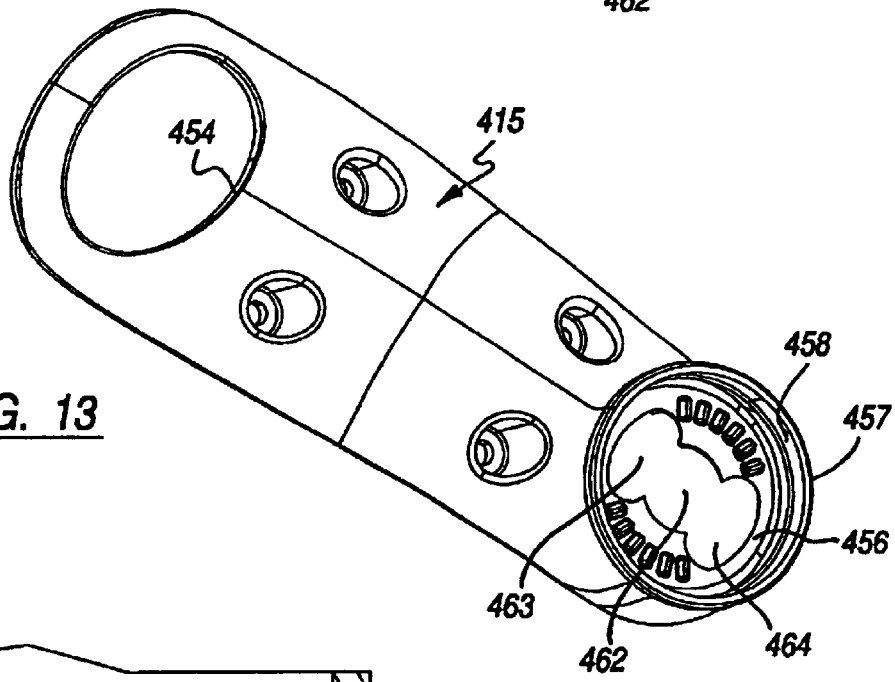
FIG. 13 is an upward looking isometric view of the armrest base.
Figure 14:
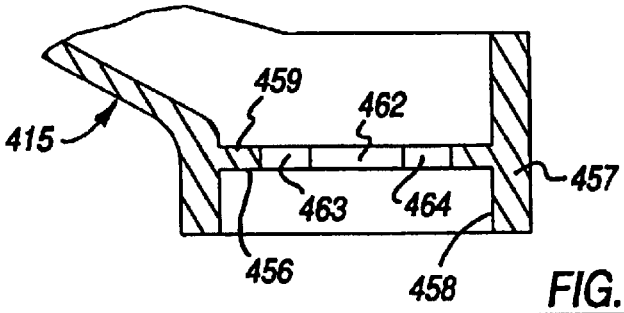
FIG. 14 is a sectional elevation view taken along line 14—14 of FIG. 12.
Figure 18:
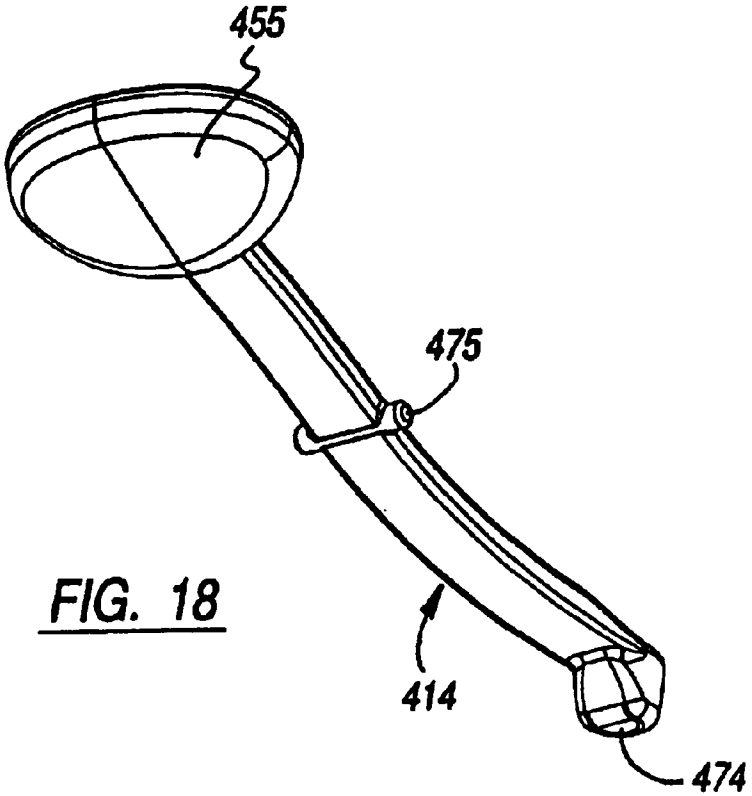
FIG. 18 is an enlarged isometric view of a lever.

Referring now to FIGS. 12–14, the armrest base 415 is shown in more detail. The base is an integral element having a large oval opening 454 at an extended end portion to accommodate a touch pad 455, FIGS. 3 and 18, of the operating lever 414. At the opposite end of the armrest base is a cuplike structure including a bottom bearing surface 456 and a downward projecting flange 457 forming a vertical bearing surface 458 for rotation about the shroud. The armrest base also includes a cup upper surface 459. The upper surface 459 includes two sets of recesses 460, 461, each in a curved format. These recesses form a detent with the cap 416 as will be explained below. The cup bottom also includes an opening having a central portion 462 and two end portions 463, 464. The end portions are curved slots to accommodate two fasteners 465, 466, FIG. 5, allowing the base to pivot until the ends of the slots abut the fasteners. The central portion 462 allows the lever to engage the top surface 447 of the activator nut 412.

Figure 15:
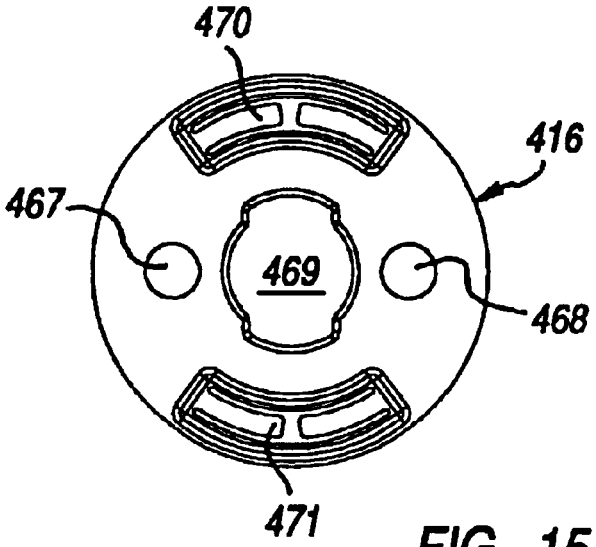
FIG. 15 is a top plan view of a cap.
Figure 16:
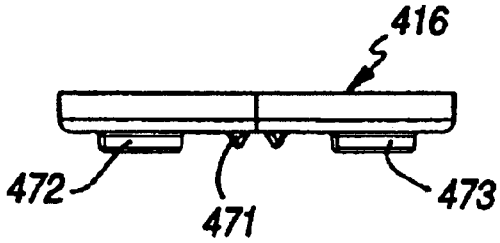
FIG. 16 is an elevation view of the cap.
Figure 17:
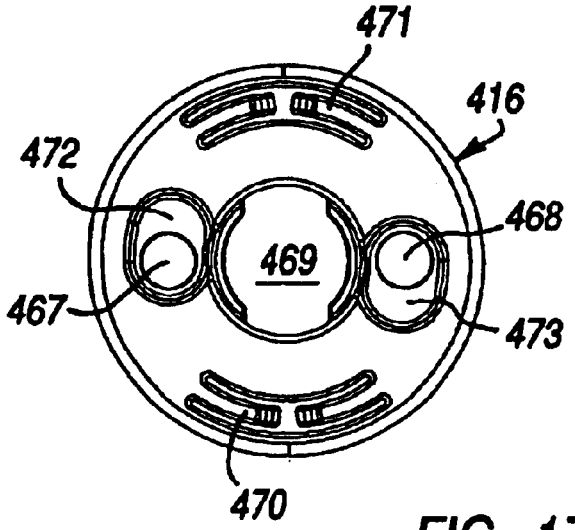
FIG. 17 is a bottom plan view of the cap.

The cap 416 includes two side openings 467, 468, FIGS. 15–17, for receiving the fasteners 465, 466 and a central opening 469 for passing the lever. The side openings are aligned with the end portion slots 463, 464. The cap also includes two sets of resiliently mounted tabs 470, 471. The tabs align with and engage the two sets of curved recesses 460, 461 on the armrest base to form a series of detents. This allows horizontal movement of the armrest base from one detent to another within about a forty-five degree arc determined by the arcs of the end portion slots 463, 464 and depending shoulders 472, 473 surrounding each opening 467, 468, respectively.

Mounted to the armrest base 415 is the lever 414 which extends from the oval opening 454 at one end of the armrest base to the central opening 462 at the other end portion of the armrest base. At the extended end of the lever is the touch pad 455, FIG. 18, while at the other end is a depending projection 474, FIGS. 4, 5 and 18, that makes contact with the upper surface 447 of the activator nut 412. The lever is mounted to pivot about pivot point 475 such that an upward force on the touch pad 455 causes the projection 474 to move downwardly. The downward movement of the lever projection causes the activator nut to move from its raised position to its lowered position thereby causing the rod 409 to rotate and disengage the locking element 410 from the notches 406.

Figure 19:
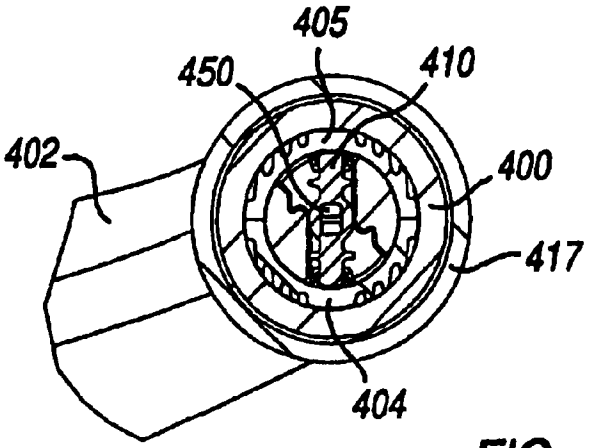
FIG. 19 is a plan sectional view taken along line 19—19 of FIG. 2 showing the armrest in a locked position.
Figure 20:
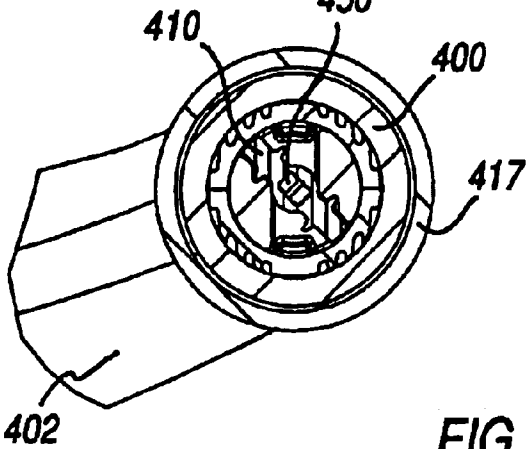
FIG. 20 is a view similar to that shown in FIG. 19 except that the armrest is shown in an unlocked position.

Referring now to FIGS. 19 and 20, the pivoting movement of the locking element 410 is clearly shown. In FIG. 19 the armrest is locked with the locking element engaging the notches 406 as also shown in FIG. 4. When the lever is activated, the locking element is pivoted out of engagement with the notches as shown in FIG. 20 and in FIG. 5.

It can now be appreciated that the armrest assembly is simply constructed, easy to form and assemble and easy to use. In operation, the relative vertical positioning of the armrest, the guide tube and the connected shroud to the upstanding support and the notched liner racks determines the height of the armrest relative to the seat of the chair. Usually the armrest is locked by the locking element engaging a pair of notches. Depressing the lever touch pad causes the projection end to bear down on the top surface of the activator nut. Since the nut cannot rotate, it is depressed causing the threadedly engaged rod to rotate. Rotation of the rod causes the locking element to rotate 45 degrees out of engagement with the pair of notches. The armrest may then be manually adjusted upwardly or downwardly. Once the force on the lever is released, the spring mounted to the guide tube causes the actuator nut to return to its raised position. This linear movement of the activator nut causes reverse rotation of the rod and the locking element causing the locking element to engage a new pair of notches. When this occurs, the armrest is locked in its new position.

Adjusting the armrest in a horizontal direction requires only the movement of the armrest to pivot it outwardly or inwardly within an arc of about 45 degrees. The resiliently mounted tabs of the cap move from one pair of recesses to another pair in the armrest base. This detent mechanism allows the armrest to pivot between six discreet positions. Movement occurs when the force on the armrest is sufficient to move the resilient tabs out of engagement with a pair of recesses.

What has been described is a simply constructed and reliable armrest assembly that is adjustable both vertically and horizontally. These adjustments may be easily made through simple manipulation of portions of the armrest assembly.

The specification above describes in detail a preferred embodiment of the present invention. Other examples, embodiments, modifications and variations will under both the literal claim language and the doctrine of equivalent come within the scope of the invention defined by the appended claims. For example, changing the shape or size of the armrest, the shroud, the armrest base, the guide tube, the rod, the locking element, the notches or the cap are considered equivalent structures and will also come within the literal language of the claims. Further, making design changes to the activator nut or lever are also considered equivalent structures. Still other alternatives will also be equivalent as will many new technologies. There is no desire or intention here to limit in any way the application of the doctrine of equivalents nor to limit or restrict the scope of the invention.

What is claimed is:

1. A vertically and horizontally adjustable chair armrest comprising:

a support for connecting to a chair, said support having a longitudinally extending opening;

a plurality of notches located in said opening;

a guide tube positioned in said opening of said support, said guide tube being movable relative to said support in a longitudinal direction wherein the height of said guide tube relative to said support is changeable;

an elongated element mounted in said guide tube, said elongated element being rotatable relative to said guide tube;

a locking element mounted to said elongated element and rotatable therewith to selectively engage and disengage said notches;

an activator mounted to said elongated element, said activator being movable relative to said elongated element and causing said elongated element to rotate;

a spring operatively connected to said activator for biasing said activator;

a lever operatively connected to said support for causing said activator to move;

a cap mounted to said guide tube; and an armrest base operatively connected to said cap, said armrest base being movable in a generally horizontal direction relative to said cap.

2. The armrest as claimed in claim 1 wherein:

said activator is a nut threadedly engaged to said elongated element, where linear movement of said nut causes rotation of said elongated element.

3. The armrest as claimed in claim 2 wherein:

said nut and said guide tube are keyed together to prevent said nut from rotation.

4. The armrest as claimed in claim 1 wherein:

said guide tube has an annular recess for mounting said spring; and said activator has a shoulder for bearing against set spring.

5. The armrest as claimed in claim 4 wherein:

said lever is pivotally supported by said armrest base where pivoting said lever causes said activator to compress said spring.

6. The armrest as claimed in claim 5 wherein:

said activator is a nut threaded engaged to said elongated element where linear movement of said nut causes rotation of said elongated element.

7. The armrest as claimed in claim 6 wherein:

said nut and said guide rube are keyed together to prevent said nut from rotating.

8. The armrest is as claimed in claim 1 wherein:

said cap includes a depending resilient tab; and said armrest base includes a plurality of recesses for receiving said tab to form a detent.

9. The armrest as claimed in claim 8 wherein:

said cap has an annular shape with two oppositely disposed tabs; and said armrest base includes a first arc of recesses and a second arc of recesses oppositely disposed.

10. The armrest as claimed in claim 8 wherein:

said activator is a nut threadedly engaged to said elongated element where linear movement of said nut causes said elongated element to rotate.

11. The armrest as claimed in claim 10 wherein:

said nut and said guide tube are keyed together to prevent rotation of said nut;

said activator has a shoulder for bearing against set spring.

12. The armrest as claimed in claim 11 wherein:

said guide tube has an annular recess for mounting said spring; and said activator has a shoulder for bearing against said spring.

13. The armrest as claimed in claim 12 wherein:

said lever is pivotally supported by said armrest base where pivoting said lever causes said activator to compress said spring.

14. The armrest as claimed in claim 13 wherein:

said cap has an annular shape with two oppositely disposed tabs; and said armrest base includes a first arc of recesses and a second arc of recesses oppositely disposed.

* * * * *